US007784310B1

(12) United States Patent
Bradford et al.

(10) Patent No.: US 7,784,310 B1
(45) Date of Patent: Aug. 31, 2010

(54) AUTOMATIC BATCH ARTICLE WASHING MACHINE

(76) Inventors: Stephen D. Bradford, 1232 C Laguna St., Santa Barbara, CA (US) 93101; Kirsten M. Bradford, 6130 W. 7th St., Los Angeles, CA (US) 90045

( * ) Notice: Subject to any disclaimer, the term of this patent is extended or adjusted under 35 U.S.C. 154(b) by 489 days.

(21) Appl. No.: 11/406,413

(22) Filed: Apr. 18, 2006

(51) Int. Cl.
*D06F 39/02* (2006.01)

(52) U.S. Cl. ..... 68/12.18; 68/17 R

(58) Field of Classification Search ..... 68/17 R, 68/12.18, 12.27
See application file for complete search history.

(56) References Cited

U.S. PATENT DOCUMENTS

| | | | | |
|---|---|---|---|---|
| 3,881,328 | A | 5/1975 | Kleimola et al. | |
| 3,982,666 | A | 9/1976 | Kleimola et al. | |
| 4,103,520 | A | 8/1978 | Jarvis et al. | |
| 4,503,575 | A | 3/1985 | Knoop | |
| 4,932,227 | A | 6/1990 | Hogrefe | |
| 5,161,393 | A | 11/1992 | Payne et al. | |
| 5,207,080 | A | 5/1993 | Reinhard | |
| 5,241,845 | A | 9/1993 | Ishibashi et al. | |
| 5,469,719 | A | 11/1995 | Imai et al. | |
| 5,727,402 | A | 3/1998 | Wada | |
| 6,035,472 | A * | 3/2000 | Barbe | 8/158 |
| 6,041,625 | A | 3/2000 | Nagai et al. | |
| 6,055,831 | A * | 5/2000 | Barbe | 68/12.18 |
| 6,509,558 | B1 | 1/2003 | Loch et al. | |
| 6,553,596 | B2 | 4/2003 | Kim et al. | |
| 6,760,942 | B2 | 7/2004 | Lee et al. | |
| 6,842,928 | B2 | 1/2005 | Yang et al. | |
| 2001/0049948 | A1 | 12/2001 | Jo et al. | |
| 2003/0019253 | A1 | 1/2003 | Lorenz et al. | |
| 2003/0116177 | A1 | 6/2003 | Appel et al. | |

* cited by examiner

*Primary Examiner*—Joseph L Perrin

(57) ABSTRACT

This invention relates to an automatic batch washing machine where the potential product or products that are being cleaned includes, but is not limited to, clothes and dishes. The machine combines user input and data gathered from sensors to operate to automatically dispense all necessary cleaning and treatment chemicals at proper times and optimally measured doses. Manual measurement and insertion of requisite chemicals has been eliminated. Efficiency and performance are enhanced through the use of optimally measured, timed and placed chemical dispensions. The chemical supply containers incorporated in conjunction with the machine are marked in such a way that they can only be inserted in a certain location in conjunction with the machine eliminating the possibility of mistakingly locating one chemical in a dispensing location for another chemical.

4 Claims, 3 Drawing Sheets

AUTOMATIC BATCH ARTICLE WASHING MACHINE

BACKGROUND OF THE INVENTION

1. Field of the Invention

The subject matter of the present invention is directed to a washing machine and more particularly to a machine that is to automatically dispense the necessary cleaning and treatment chemicals at the proper times in optimally measured doses within the wash basin of the machine.

2. Description of the Related Art

Automatic washing machines for cleaning of dishes and clothes have long been known. Most automatic washing machines are designed to dispense the proper amount of water within the wash basin of the machine or to control the size of the load that is to be handled by the machine. In a clothes washing machine, different chemicals are commonly provided. These different chemicals include detergent, bleach and softeners. It would be desirable to insure that the precise amount of each chemical is to be dispensed according to what parameters have been programmed into the machine. The programming of the parameters are to be accomplished by the user. In other words, the user would program in whether the clothes were white clothes or colored clothes and whether it is a light load, a medium load or a heavy load. Once these parameters have been inserted into the machine, it would be desirable to have the machine dispense the exact amount of chemicals at the correct times within the wash basin of the machine. In the past, there has not been known a machine that has been designed to achieve this end result.

There are numerous prior art automatic washing machines which are designed to sense the type and/or volume of material to be washed or the soil level of the articles that are to be washed. This knowledge is to allow the machine to adjust the amount of water, the rinse type and the motor action to enhance the cleaning and minimize garment degradation. However, these prior art machines still require the user to manually dispense cleaning and treatment agents into the machine. There is a potential for dosing mistakes in relation to the manual selection of the amount of the cleaning agent and at the time that it is to be inserted in conjunction with the machine. These dosing mistakes lead to inefficient cleaning and even possible damage when the article being cleaned is clothing.

Reference is to be had within the prior art to U.S. Pat. Nos. 3,881,328 and 3,982,666 that describe a dispensing system which is triggered by a signaling device in the washing machine to activate and deactivate solenoid valves allowing injection of various liquid cleaning products through venturi-aspirators into a water feed hose of a machine with a timing circuit to control the amount dispensed. A similar system is described in U.S. Pat. No. 4,103,520 where a plurality of liquid additives can be injected in a predetermined sequence under the control of an adapter which is interfaced with the washing machine. The adapter includes a programmable timer to control the injection volume and sequence. Another machine, outlined in U.S. Pat. No. 4,932,227, senses flow into the washing machine water feed lines as a stimulus for a control head to selectively activate a plurality of chemical injection pumps. U.S. Pat. No. 5,207,080 lists an apparatus that monitors the electrical current draw of the washing machine to determine when the detergent should be injected into the washing machine. U.S. Patent application 2003/0116177 describes a non-intrusive automatic dosing system which senses at least one parameter from the washing machine to activate pumped chemical injection into the water feed line of the washer. One significant problem dealing with this approach is the requirement for multiple pumps which are expensive and require the use of expensive electrical power. The main disadvantage of all the aforementioned prior art machines is that such are not integrated into the washing machine and therefore not privy to the knowledge gained from user input. These prior art machines do not have a method for determining the current washing machine cycle steps. Assumptions must be made as to sequence and duration of the cycle steps which varies among machines and wash types. Further complicating the issue is the fact that in order to make some prior systems responsive the user would be required to input data twice, once to the machine and once to an adapter. The machine is still without a guarantee of proper function due to the lack of a robust feedback mechanism. Another drawback is the method of measurement of chemicals. These systems rely on timing circuits to determine the chemical dose which is indirect and subject to error. The fluid properties (density and viscosity), which affect the flow rate and thus volume measured, are not constant among all products (detergents have different properties and so do fabric softeners, etc.). Also, density and viscosity vary among the different brands of the same product. Without this knowledge, the measurement can lead to error and thus inefficient or possibly harmful chemical dosing.

U.S. Pat. No. 4,503,575 takes some of the prior issues into account. This fully integrated washing machine collects user input and sensor acquired knowledge to make decisions about the type of chemicals needed. It then circulates water, determines the weight of the clothes and fills the reservoir. A metered amount of water is then removed from the reservoir and replaced with the same volume of chemical as measured by pressure. This metering and replacing can occur as many times as necessary before the reservoir contents are pumped into the wash basin. Though this design eliminates some drawbacks of the prior art devices, it still has some problems. First the design is not efficient in its use of energy, requiring continual recirculation to insure that the chemical contents in the reservoir are completely dispensed into the wash basin. Modern, high efficiency washers save energy by not continually pumping water during the beginning cycle, making this approach impractical. Manual loading of the chemical supply reservoirs by the user still allows for potentially serious problems. For example, bleach could accidentally be spilled into a detergent or softener receptacle ruining certain clothes, a liability which cannot be tolerated.

SUMMARY OF THE INVENTION

The basic embodiment of the present invention is directed to an automatic batch article washing machine which utilizes a wash basin adapted to contain one or more articles to be washed. A fresh water supply conduit is to be connected with the wash basin with the fresh water supply conduit to supply a selected quantity of water into and out of the wash basin upon activation of the machine. A central processing unit (CPU) is included within the machine comprising an electronic programmable computer which is to be programmed with certain initial parameters. A collection reservoir is adapted to contain contents connecting with the wash basin. A main dispensing valve is connected to the connection reservoir. Activation of the main dispensing valve by the CPU causes dispensing of the contents from the collection reservoir into the wash basin. A first supply reservoir, which is adapted to contain first contents, is connected to a first valve and a sensor. Activation of the first valve by the CPU is to cause a predetermined quantity of the first contents to be dispensed into the collection reservoir. A second supply reservoir is adapted to contain second contents with a second valve connected to the second supply reservoir. Activation of the second valve by the CPU is to cause a predetermined quantity of the second contents to be dispensed into the collection reservoir.

A further embodiment of the present invention is where the first basic embodiment is modified by defining that the supply reservoir is removable and replaceable and there is incorporated in conjunction with each of the supply reservoirs a marking means that permits only for each reservoir to be engaged with only a precise location in conjunction with the machine eliminating the mounting of the detergent containing reservoir in the area where the bleach reservoir is located or mounting it in conjunction with a softener containing reservoir.

A further embodiment of the present invention is where the first basic embodiment is modified by defining that mounted in conjunction with the collection reservoir is a sensor that determines the amount that is being dispensed from the supply reservoir into the collection reservoir and causes shutting down of the dispensing procedure from the supply reservoir.

A further embodiment of the present invention is where the first basic embodiment is modified by defining that there is included in conjunction with each supply reservoir a separate sensor with this sensor causing the actual activation to dispense the contents from the supply reservoir or causes a shutting down of the dispensing procedure.

A further embodiment of the present invention is where there is incorporated in conjunction with the collection reservoir a fresh water supply to rinse out the collection reservoir after the contents of the collection reservoir has been dispensed.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

The subject matter of this invention constitutes an automatic washing machine that is capable of cleaning clothes, dishes or any other product amenable to a batch washing process. Specifically, the machine of this invention incorporates user input with relevant sensored data to automatically dispense all necessary cleaning and treatment chemicals at the proper times in optimally measured doses. The result is a simplified interface that eliminates the need for manual measurement and insertion of requisite chemicals. Efficiency and performance are enhanced through the use of the optimally measured, timed and placed chemical dispensings. This invention incorporates the use of specially designed chemical supply containers such that the contents of the container will be known permitting only installation of the container in conjunction with the machine at a single location.

Figure 2:
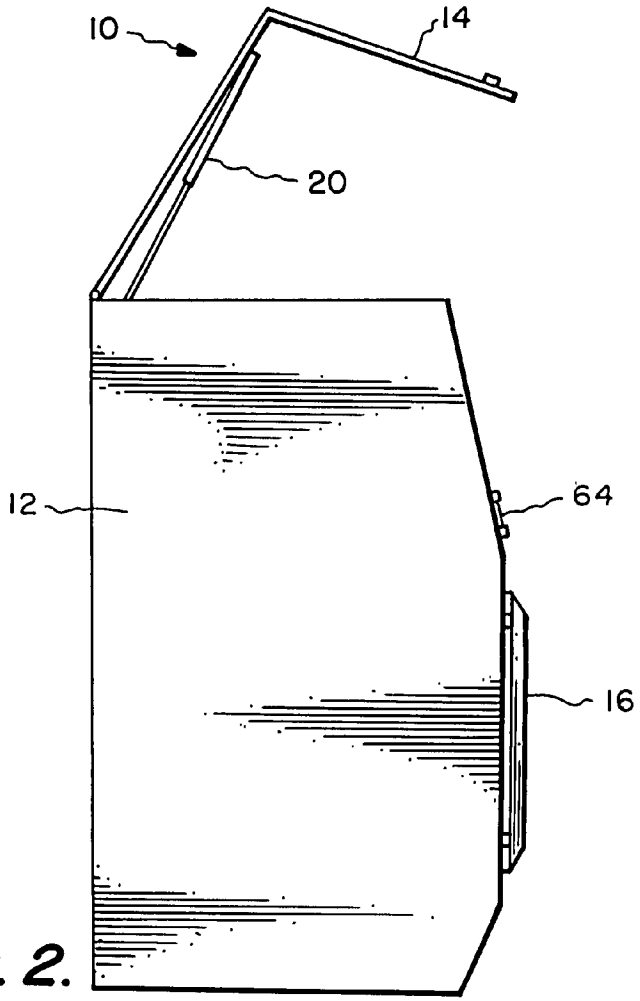
FIG. 2 is a side elevational of the machine of FIG. 1.
Figure 1:
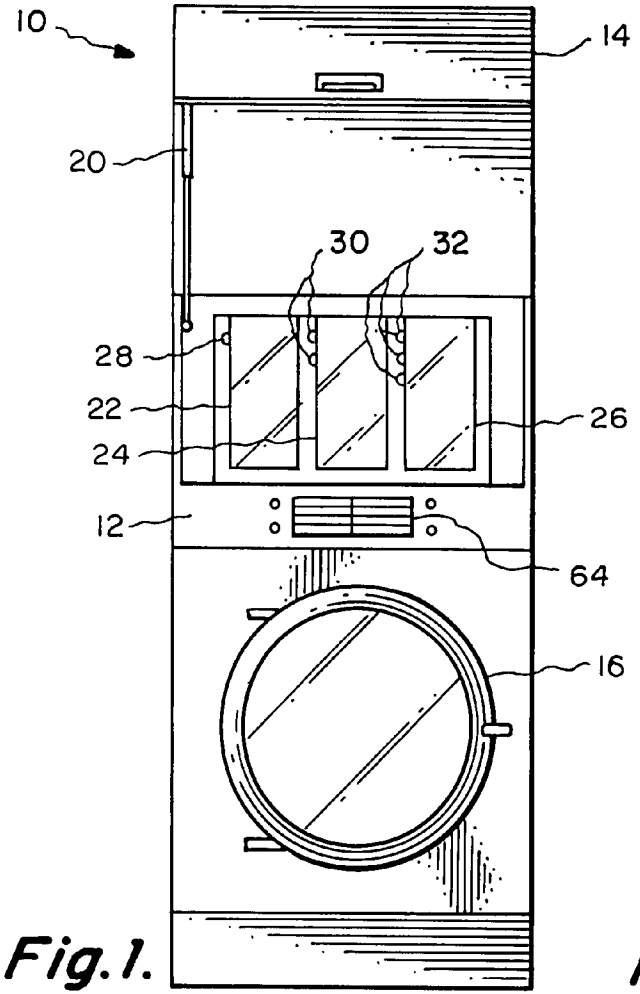
FIG. 1 is a front elevational view of a typical machine that is being constructed in accordance with the present invention.
Figure 3:
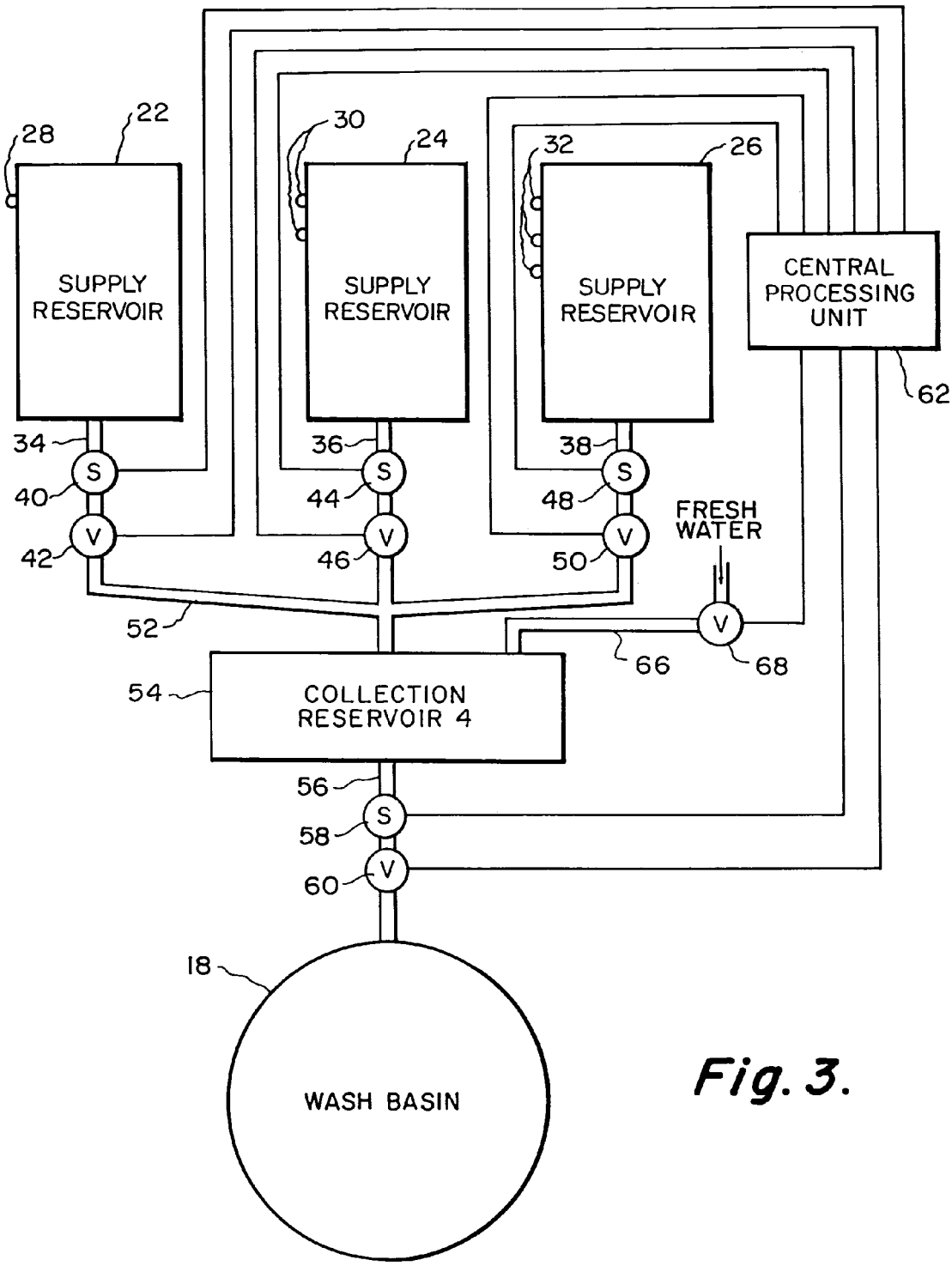
FIG. 3 is a diagrammatic view in block diagram form showing the different arrangement of parts that are incorporated in conjunction with the machine of the present invention.
Figure 4:
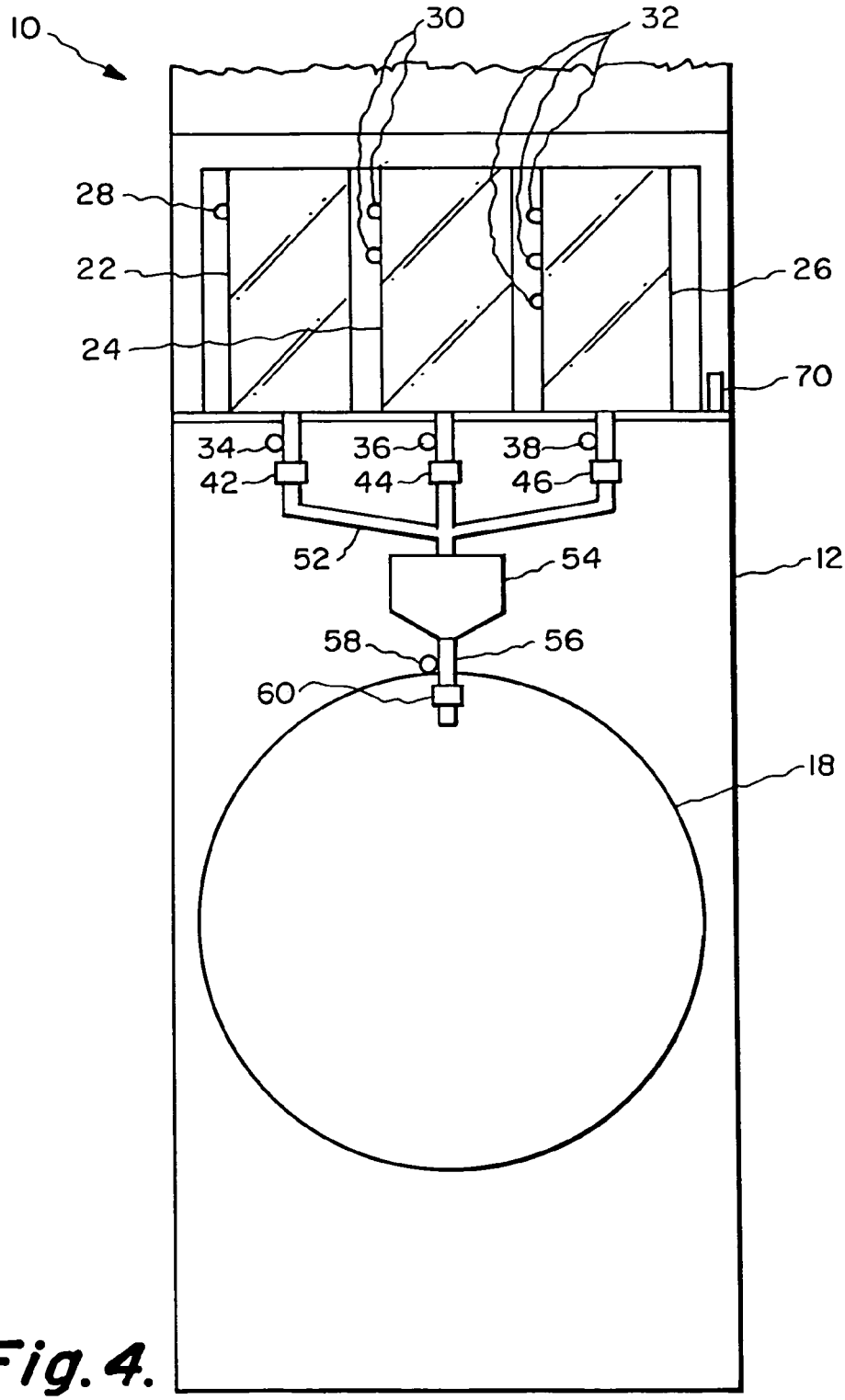
FIG. 4 is an interior elevational view of the machine of FIG. 1 showing the arrangement of parts that are consistent with the diagrammatic view of FIG. 3.

Reference is to be had particularly to FIGS. 1, 2 and 4 of the drawings where there is shown a suggested version 10 of machine of this invention. Machine 10 includes a sheet material enclosing housing 12 which has an openable top 14 and an access door 16 mounted within the front surface of the machine 10. The access door 16 provides access to a wash basin 18 which is mounted within the confines of the housing 12. The top 14 is capable of being moved to the open position and when in the open position is retained in that position by a spring actuator 20. It is to be understood that application of a manual pressure in a direction to close the top 14 in conjunction with the housing 12, that the manual pressure will overcome the pressure of the spring contained within the spring actuator 20 and the top can be readily closed. The opening of the top 14 provides access to the three in number of supply reservoirs 22, 24 and 26 mounted in the upper portion of the housing 12. Each supply reservoir 22, 24 and 26 is to be removable and replaceable. Incorporated in conjunction with each supply reservoir 22, 24 and 26 is a marking structure such that on reservoir 22 there is a single protuberance 28, on reservoir 30 there is a pair of dual protuberances 30 and on the supply reservoir 26 there are three in number of protuberances 32. The protuberances 28, 30 and 32 could be formed on the exterior surface of each of the supply reservoirs 22, 24 and 26 respectively. Other forms of a marking arrangement could be utilized. The whole intent and purpose of the marking arrangement is to prevent interchangeability so that supply reservoir 26 could not be placed at the location of supply reservoir 22 and vice versa, and also there could be no changeability between reservoirs 24 and 26. Let it be assumed that supply reservoir 22 is for detergent and therefore that only detergent can be in that location. Let's assume that supply reservoir 24 is for bleach and only bleach can be in that location. Let it be assumed that supply reservoir 26 is for fabric softener and only a fabric softener can be in that location. It would be extremely inefficient, and possibly damaging, to have a fabric softener located at the location for detergent and the detergent located at the location for fabric softener. Also, it could be extremely damaging to have a location for bleach where a fabric softener is located. It is to be understood that the protuberances 28, and 32 are to engage with certain recess or recesses formed within the housing 12 so that only that particular reservoir 22, 24, or 26 can be located at a specific location. Instead of the protuberances 28, 30 and 32, there may be used another form of marking means, such as a Radio Frequency Identification (RFID) tag, that conveys information about the container size to the CPU 62 which, when combined with stored sensor information about dosing history, would allow the machine to provide supply level statistics and alerts to the user.

Supply reservoirs 22, 24 and 26 are noted to be at a height above the wash basin 18. In order to minimize the structure that is required for the dispensing of the contents contained within each of the reservoirs 22, 24 and 26, gravity is to be used if these reservoirs are located at a height above the wash basin 18, flow from the reservoirs 22, 24 and 26 can occur by gravity not requiring the use of any separate pumping devices. The supply reservoir 22 has a dispensing conduit 34. Supply reservoir 24 has a dispensing conduit 36. Supply reservoir 26 has a dispensing conduit 38. It is to be understood that although within the specification three in number of supply reservoirs are shown, it is considered to be within the scope of this invention that a greater number could be utilized or a lesser number.

Mounted in conjunction with the dispensing conduit 34 is a sensor 40 and a valve 42. A similar sensor 44 and valve 46 are mounted in conjunction with the dispensing conduit 36. A still similar sensor 48 and valve 50 are mounted in conjunction with the dispensing conduit 38. Each of the dispensing conduits 34, 36 and 38 are joined to a manifold conduit 52. The manifold conduit 52 connects to a collection reservoir 54. The collection reservoir 54 is to be totally enclosed and is not removable and replaceable in conjunction with the machine 10. The collection reservoir 54 has an outlet conduit 56. Connected in conjunction with the outlet conduit 56 is a main sensor 58 and a main valve 60. The outlet conduit 56 is designed to dispense contents from the collection reservoir 54 directly into the interior of the wash basin 18.

The sensors 40, 44, 48 and 58 are all connected to the central processing unit (CPU) 62. Each of the valves 42, 46, 50 and 60 are also connected to the CPU 62. The preferable CPU would be a small, easily programmable, low power consumption electronic computer unit capable of simple calculations containing non-volatile memory in an easily expandable interface. It must be capable of combining the user input and sensor data in the commands for proper activation of all the valves. One such desirable CPU would be model no. PXA27X, manufactured by Intel Corp. The controlling of the CPU 62 is to be achieved by using manual input in conjunction with touch screen 64 mounted on the front of the housing 12. The valves 42, 46, 50 and 60 can comprise any kind of a solenoid operated ball, cone-type, spool or piston valve.

The structure of each of the sensors 40, 44, 48 and 58 could comprise a Mems Tech MPS-501G piezoresistive pressure sensor. Once tapped into the side of its respective conduit, the hydrostatic pressure within the conduit deforms the internal diaphragm (not shown) contained within the sensor. This deforming of the internal diaphragm causes four piezoresistors, connected together in a Wheatstone Bridge configuration, to change their electrical resistances. This change in resistance results in a pressure proportional voltage that is monitored by the CPU 62. It is to be understood that within the scope of this invention, other types of sensors could be utilized.

For the insertion of fresh water within the wash basin 18, there is provided a fresh water inlet conduit 66 that supplies water into the collection reservoir 54 upon opening of valve 68. This fresh water supply inlet conduit 66 can be utilized for the purpose of washing out the interior of the collection reservoir 54 which will be discharged into the wash basin 18.

The sensors 40, 44, 48 and 58 monitor their respective reservoir 22, 24, 26, and 54 to determine the fluid levels of their reservoir. Understanding that the pressure is equal to the product of the vertical height of the fluid, the fluid density and the acceleration due to gravity, knowledge of the latter two allows determination of the vertical height of the fluid contained within their respective reservoirs. Each of the valves 42, 46, 50 and 60 are controlled by a computer algorithm which is based on user input and relevant sensor data. Each valve 42, 46, 50 and 60 is opened at a specific time to dispense the contents of its respective reservoir 22, 24, 26 and 54. Sensor 58 determines the amount dispensed from each reservoir 22, 24 and 26 and feeds this information back to the CPU 62. CPU 62 supplies the signal to the valves 42, 46 and 50 respectively to close these valves when the proper amount of chemical has been dispensed from the regular reservoirs 22, 24 and 26. Operation of the machine 10 of this invention should require that the user only need to load the appropriate material to be cleaned, select the appropriate cycle, such as a heavy wash cycle, normal wash cycle or a delicate wash cycle and then press the start button for the machine 10. The start button would be located on the touch screen 64.

In order for the machine 10 to work properly with the multiple chemical sources 22, 24 and 26, it is important that the CPU 62 know which of the valves 42, 36 and 50 are to be opened and dispense the contents of its respective reservoir. The sensor 70 could be used to collect data on the reservoirs 22, 24 and 26 through optical scanning of specific container surface markings. Alternatively, sensor 70 could gather information from Radio Frequency Identification (RFID) tags embedded in the containers, or other similar means. With this knowledge, CPU 62 would be able to insure proper dosing of the correct chemical contained within the reservoirs 22, 24 and 26 rather than be subject to predetermined factory settings. This arrangement could also be used to hinder the use of imitation or counterfeit chemical products within the machine 10. Sensors 40, 44 and 48 serve the purpose of determining the amount of product remaining in each corresponding reservoir in a manner similar to sensor 58. This data would allow the machine to alert the user to the amount of product remaining and when a reservoir container required replacement. An alternative embodiment is such that the CPU 62 would store data about the dispensing history to determine the amount of product used from each container. When combined with this data about the container size gathered from sensor 70, similar product level reports and warnings could be issued to the user without the need for sensors 40, 44 and 48.

The collection reservoir 54 is shown in box diagram form and for ease of description to the box diagram is shown to be wider than taller. In actual practice, the collection 54 will probably be relatively thin and have a significant height. Therefore, only a small amount of the substance or contents contained within the collection reservoir 54 need to be dispensed to result in a clear change of the level of the contents within the reservoir 54. This would be desirable when utilizing the sensor 58 so that the change in the volume of the reservoir 54 can be readily perceived by the sensor 58.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. An automatic batch article washing machine comprising:

a wash basin adapted to contain an article(s) to be washed;

a central processing unit (CPU) included within said machine, said CPU comprising an electronic programmable computer which is to be preprogrammed with certain initial parameters and able to receive external input via a user interface, said interface also included within said machine;

a collection reservoir adapted to contain contents connecting with said wash basin, a main dispensing valve connected to said connection reservoir, activation of said main dispensing valve by said CPU causes emptying of the contents of said collection reservoir into said wash basin;

a first supply reservoir adapted to contain first contents, a first valve connected to said first supply reservoir, activation of said first valve by said CPU is to cause a predetermined quantity of first contents to be dispensed into said collection reservoir;

a second supply reservoir adapted to contain second contents, a second valve connected to said second supply reservoir, activation of said second valve by said CPU is to cause a predetermined quantity of said second contents to be dispensed into said collection reservoir; and each said supply reservoir including a marking means with there being a different marking means for each said supply reservoir, said marking means allowing the transfer of information about each said supply reservoir to a sensor integrated in said machine and permitting installation of said supply reservoir at only a single location in conjunction with said machine, each said, supply reservoir being removable and replaceable; and a fresh water supply connected to said machine, said fresh water supply to function to supply a selected quantity of fresh water into said wash basin and to rinse out said collection reservoir after discharge of the contents from said collection reservoir into said wash basin.

2. The automatic batch article washing machine as defined in claim 1 wherein:

a main sensor mounted in conjunction with said collection reservoir, said main sensor to ascertain the amount of discharge of said first contents or said second contents into said collection reservoir and via said CPU and said first valve or said second valve, cause shutting off of the discharge of said first contents or said second contents, respectively, to said collection reservoir upon the desired amount of contents being supplied within said collection reservoir.

3. The automatic batch article washing machine as defined in claim 1 wherein:

a separate sensor is mounted in conjunction with each said supply reservoir with each said sensor having function to indicate to said CPU the level of liquid contained in each said supply reservoir and with said CPU to cause discharge of the contents from said supply reservoir into said wash basin and also to terminate the supply of contents from said supply reservoir into said wash basin without the need for said collection reservoir or said main dispensing valve.

4. The automatic batch article washing machine as defined in claim 1 wherein:

a third supply reservoir adapted to contain third contents, a third valve connected to said third supply reservoir, activation of said third valve by said CPU is to cause a predetermined quantity of said third contents to be dispensed into said collection reservoir.

* * * * *